US006997731B1

(12) United States Patent
Wood et al.

(10) Patent No.: US 6,997,731 B1
(45) Date of Patent: Feb. 14, 2006

(54) HERMAPHRODITE CONNECTOR

(75) Inventors: Richard Wood, Sugar Land, TX (US); Leo M. Dekkers, Houston, TX (US)

(73) Assignee: Input/Output, Inc., Stafford, TX (US)

( * ) Notice: Subject to any disclaimer, the term of this patent is extended or adjusted under 35 U.S.C. 154(b) by 0 days.

(21) Appl. No.: 10/872,676

(22) Filed: Jun. 21, 2004

(51) Int. Cl.

| | |
|---|---|
| ***H01R 13/62*** | (2006.01) |
| ***H01R 13/213*** | (2006.01) |
| ***H01R 13/28*** | (2006.01) |
| ***H01R 25/00*** | (2006.01) |

(52) U.S. Cl. ..... 439/314; 439/294; 439/316

(58) Field of Classification Search ..... 439/292, 439/294, 299, 310, 311, 314, 316
See application file for complete search history.

(56) References Cited

U.S. PATENT DOCUMENTS

| | | | | |
|---|---|---|---|---|
| 3,855,566 | A * | 12/1974 | Richardson | 439/294 |
| 4,037,902 | A | 7/1977 | Miller | 339/49 R |
| 6,354,852 | B2 * | 3/2002 | Noro et al. | 439/157 |
| 6,447,319 | B1 | 9/2002 | Bodin | 439/314 |

* cited by examiner

*Primary Examiner*—Chandrika Prasad
(74) *Attorney, Agent, or Firm*—Madan, Mossman & Sriram, P.C.

(57) ABSTRACT

A seismic cable coupling comprising connector body, a coupling ring is rotatably mounted on the connector body. The coupling ring includes a ring body having a first longitudinal projection and a second longitudinal projection, the first longitudinal projection having an interior surface including a first angled groove, the second longitudinal projection having an exterior surface including a first raised stud. The coupling ring is a hermaphrodite coupling ring that mates with a coupling ring having a substantially identical ring body.

24 Claims, 7 Drawing Sheets

HERMAPHRODITE CONNECTOR

BACKGROUND OF THE INVENTION

1. Field of the Invention

This invention relates generally to apparatus and methods used for seismic surveying, and more particularly to a cable connector and method for assembling a seismic survey system.

2. Description of the Related Art

Seismic surveys are conducted by deploying a large array of seismic sensors over a surface portion of the earth. Typically, these arrays cover 50 square miles and may include 2000 to 5000 seismic sensors. An energy source (buried dynamite for example) is discharged within the array and the resulting shock wave is an acoustic wave that propagates through the subsurface structures of the earth. A portion of the wave is reflected at underground discontinuities, such as oil and gas reservoirs. These reflections are then sensed at the surface by the sensor array and recorded. Such sensing and recording are referred to herein as seismic data acquisition, which might also be performed in a passive mode without an active seismic energy source.

A three dimensional map, or seismic image, of the subsurface structures is generated by moving the energy source to different locations while collecting data within the array. This map is then used to make decisions about drilling locations, reservoir size and pay zone depth.

The typical seismic surveying system includes a large number of sensors cabled together in an array and to a field box. Any number of these sensor arrays and boxes are then coupled together depending on the size of the survey area to form a spread. And the field boxes and sensor arrays are then coupled to a central controller/recorder.

The traditional sensor has long been a geophone velocity measuring sensor. Today, accelerometers are becoming more widely utilized, and multi-axis, or multi-component, accelerometers are emerging. Multi-component (three axis) sensing has shown to give superior images of the subsurface as compared to single component sensing. Multi-component sensing, however, has not been economically viable in the past due to the added cost of the recording system and implementation problems with multi-component analog sensors. With the advent of the multi-component digital sensor, such as the Vectorseis® sensor module available from Input/Output, Inc., Stafford, Tex., a multi-component digital sensor is now practical. Multi-component recording, however, requires higher sensor density than single component recording to realize the full advantage seismic imaging with multi-component recording.

The most popular architecture of current seismic data acquisition systems is a point-to-point cable connection of all of the sensors. Output signals from the sensors are usually digitized and relayed down the cable lines to a high-speed backbone field processing device or field box. The high-speed backbone is typically connected in a point-to-point relay fashion with other field boxes and then to a central recording system where all of the data are recorded onto magnetic tape.

Seismic data may be recorded at the field boxes for later retrieval, and in some cases a leading field box will communicate command and control information with the central recorder over a radio link. Still, there exists miles of cabling between the individual field boxes, between the field boxes and sensor lines, and between the sensors.

The typical cable system architecture results in more than 100 miles of cable deployed over the survey area. The deployment of miles of cable over varying terrain requires significant equipment and labor, often in harsh environments.

FIG. 1 depicts a typical seismic data acquisition system 100. The typical system 100 includes an array ("string") of spaced-apart seismic sensor units 102. Each string of sensors is typically coupled via cabling to a data acquisition device ("field box") 103, and several data acquisition devices and associated string of sensors are coupled via cabling 110 to form a line 108, which is then coupled via cabling 110 to a line tap or ("crossline unit") 104. Several crossline units and associated lines are usually coupled together and then to a central controller 106 housing a main recorder (not shown). The typical sensor unit 102 in use today is a velocity geophone used to measure acoustic wave velocity traveling in the earth. Recently, and as noted above, acceleration sensors (accelerometers) are finding more widespread acceptance for measuring acceleration associated with the acoustic wave. Each sensor unit might comprise a single sensor element or more than one sensor element for multi-component seismic sensor units.

The sensors 102 are usually spaced at least on the order of tens of meters, e.g., 13.8–220.0 feet. Each of the crossline units 104 typically performs some signal processing and then stores the processed signals as seismic information for later retrieval as explained above. The crossline units 104 are each coupled, either in parallel or in series with one of the units 104*a* serving as an interface with between the central controller 106 and all crossline units 104.

Cables 110 must be connected to each other, to field boxes 103, to crossline units 104 and to the controller/recorder 106 to make up the system 100. Consequently, the cables and boxes must utilize connectors 112 that enable assembling the system 100 and that enable disassembling for moving the system 100 to a new survey location and after a survey is complete.

Connectors in the typical seismic system have long been a source of frustration in the field. Harsh environmental conditions, debris and complexity all contribute to difficulty in making up the system and in disassembling the system. Temperatures may be on the order of 40° below zero Fahrenheit or lower and upwards of 110° or more. Furthermore, seismic cables are often connected and disconnected during times of freezing rain and/or snow.

The typical connector often seizes under harsh conditions making connections and disconnections difficult if not impossible. The typical connector also usually has different connector types for corresponding connector halves and seismic crews must have both types of connector halves at the ready for field repair.

Some connectors today use threaded connector locking rings with a male side threaded into a threaded female receptacle. These connectors require the operator to press the electrical pins and sockets together and then the locking ring is rotated multiple rotations to complete the connections.

Disconnecting the connector is accomplished by unscrewing the locking ring and then the operator can pull the electrical connections apart. When the connector is difficult to disconnect due to debris, freezing or misalignment, the operator is often tempted to pull on the cables. Pulling cables rather than connector housings leads to damage to the electrical components.

These threaded connectors also suffer from the fact that different structural parts are used for each half of the coupling. That is, a male half and a female half. Repairs require both components be available, which sometimes leads to waste where one half is not needed for a repair. These non-hermaphrodite connectors also require different machining in manufacturing making manufacturing more expensive.

Attempts have been made to address the problems associated with the non-hermaphrodite connector. Connectors have been proposed that provide hermaphrodite electrical and mechanical components, and proposed connectors attempt to address the issues associated with longitudinal force application.

One example of a hermaphrodite connector assembly is U.S. Pat. No. 6,447,319 to Jaques Bodin. The connector described in the '319 patent is used in making up geophysical data acquisition and processing systems. The connector coupling consists of two identical electrically and mechanically fitting male/female connectors, each connector comprising a body bearing a set of connection pins and a ring enclosing the connector body base and capable of being moved in rotation relatively to the body, the connector ring comprising a raised motif for plugging in the associated connector. Each connector comprises two stages of raised motif of which one front raised stage substantially matching the ring motif to co-operate with the associated connector ring motif in a locked position of the device and a rear stage to co-operate with the ring motif of the same connector in a retracted position of the ring.

One problem with a connector according to the '319 patent is that initial longitudinal coupling force must be applied by a person mating the connectors. Another problem is that a corresponding decoupling force must be applied after the connectors are unlocked. Starting from a situation in which two aligned connectors according to the '319 patent have their ring in the retracted position, the front faces of the two connectors are moved towards each other in translation. The projecting members of one of the two connectors (the members 140 and 150 in FIG. 1 of the '319 reference) are engaged in the spaces between the like members of the other connector. The members therefore interpenetrate in a complementary manner.

The '319 reference teaches that during interengagement of the projecting members, the chimneys of each connector enter the cavities of the other connector and the male and female contacts of the two connectors connect the four wires of the cable of each connector in pairs.

Once this translatory interengagement has been completed, the device is locked by turning at least one of the rings approximately 90° to engage the projecting part of the ring in the grooves on the body of the other connector.

Co-operation of the helicoidal ramps on the projecting parts of the ring with those in the grooves of the body of the other connector converts this 90° rotation into helicoidal movement of the ring of one connector relative to the body of the other connector this tightens the mechanical connection, which is then "screwed tight".

U.S. Pat. No. 4,037,902 describes a hermaphrodite cable connector assembly that may be used in seismic survey systems. The '902 reference teaches a multiple connector plug having a front or mating end, and a back or cable end, comprising a cylindrical body having a contact assembly, including means to support a plurality of electrical contacts. The contact assembly surrounds and is sealed to the body, and has projections adapted to mesh with the corresponding projections on the contact assembly of a mating plug, so as to relatively index the two plugs and their contacts. The plug has a cylindrical tubular locking ring with diametrically disposed extensions which mesh with the extensions of the locking ring on a mating plug. There are sloping grooves and ridges on the projections so that as the locking ring is rotated clockwise with respect to a locking ring on a mating plug, the two plugs will be pulled and locked together. When the locking rings are turned counterclockwise with respect to each other, cam surfaces on the ends of the projections act to unlock and separate the two plugs.

FIG. 8 in the '902 reference, illustrates the meshing of the interior ridge 88A into the exterior slot 86, and the exterior ridge 88 into the interior slot 86A.

At the start, these meshing ridges and slots (or cams 86, 86A) mesh at the starting edges 87, 87A, then as the locking rings are rotated clockwise with respect to each other, according to the arrows 98, 98A, they begin to pull the locking rings together, and with them, the plugs.

The outer edges 89 of the projections are formed with cam slopes 90. By counterclockwise rotation of the locking rings, the cam surfaces come into play and separate the plugs.

FIG. 8 of the '902 reference shows that the plugs are locked by sliding the extensions 84 in the direction of the arrows 98, 98A. This corresponds to clockwise rotation of the locking rings with respect to each other. A turn of about 90° is required to close and lock the plugs.

The '902 reference illustrates the action of unlocking in FIG. 6, which shows the locking rings unmeshed, but the plug contacts still meshed. Another 30° of counterclockwise rotation in the direction of arrows 99, 99A will cause the two pairs of cam surfaces 90, 90A to press the two plugs apart, until the contacts are separated.

It is important to note the interaction of cam surfaces 90 and 90A for providing longitudinal forces. Such large surface area interaction will provide a corresponding frictional force that opposes the rotation of the locking rings.

The typical hermaphrodite connector that reduces the need for multiple connector type still suffers from seizing. The proposed connectors attempting to reduce longitudinal force requirements still suffer seizing due to high interface friction and large surface area contact.

Debris such as mud and ice can also make mating the typical hermaphrodite connector difficult. Debris in the grooves can block interfacing ridges and the field crew must waste time to clean the connector in order to successfully mate the connector.

In view of the problems associated with the typical connectors described above, there is a need for a seismic cable connector that is hermaphrodite, does not require longitudinal input force from a technician for connecting and disconnecting, and is less susceptible to debris-related failures in the mating structure.

SUMMARY OF THE INVENTION

The present invention addresses the above-noted deficiencies and provides a seismic cable coupling with quarter-turn coupling and decoupling with reduced susceptibility to seizing and with self-cleaning capability.

One aspect of the invention is a seismic cable coupling comprising a cable having a first connector body, a second connector body adapted for mechanical and electrical coupling to the first connector body. A first coupling ring is rotatably mounted on the first connector body. The first coupling ring includes a first ring body having a first longitudinal projection and a second longitudinal projection, the first longitudinal projection having an interior surface including a first angled groove, the second longitudinal projection having an exterior surface including a first raised stud. A second coupling ring is coupled to the second connector body, the second coupling ring includes a second ring body having a third longitudinal projection and a fourth longitudinal projection, the third longitudinal projection having an interior surface including a second angled groove, the fourth longitudinal projection having an exterior surface including a second raised stud. The first ring body couples to the second body when the second raised stud aligns with the first groove and the first raised stud aligns with the second groove, and wherein relative rotation of the first ring body to the second ring body provides an axial coupling force.

In one embodiment the relative rotation is a clockwise rotation for providing the axial coupling force and relative counterclockwise rotation provides a decoupling force. In another embodiment the relative rotation is a counterclockwise rotation for providing the axial coupling force and relative clockwise rotation provides a decoupling force. In another embodiment the first coupling ring comprises a removable retaining ring, the first coupling ring being detachable by removing the retaining ring. The second connector body may be a panel-mount connector, and the second coupling ring may include a removable through pin attaching the second coupling ring to the second connector body, the second coupling ring being detachable from the second connector body by removing the through pin.

The groove in either coupling may have a surface having a curved or multi-sided cross section, and the raised stud in either coupling may have a cross section shape being a circle, an oval, a square or a rectangle.

In another embodiment the first longitudinal projection and the third longitudinal projection include an opening at an end of the respective groove that allows self cleaning when the corresponding raised stud travels through the groove.

One embodiment of the present invention is a method of coupling a seismic cable that includes providing a cable having a first connector body and providing a second connector body adapted for mechanical and electrical coupling to the first connector body. The method includes providing a rotatable first coupling ring on the first connector body, the first coupling ring including a first ring body having a first longitudinal projection and a second longitudinal projection, the first longitudinal projection having an interior surface including a first angled groove, the second longitudinal projection having an exterior surface including a first raised stud. The method further includes providing a second coupling ring on the second connector body, the second coupling ring including a second ring body having a third longitudinal projection and a fourth longitudinal projection, the third longitudinal projection having an interior surface including a second angled groove, the fourth longitudinal projection having an exterior surface including a second raised stud. The coupling is made by aligning the second raised stud with the first groove and aligning the first raised stud with the second groove, and rotating the first ring body relative to the second ring body to provide an axial coupling force coupling the seismic cable.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE INVENTION

Figure 2:
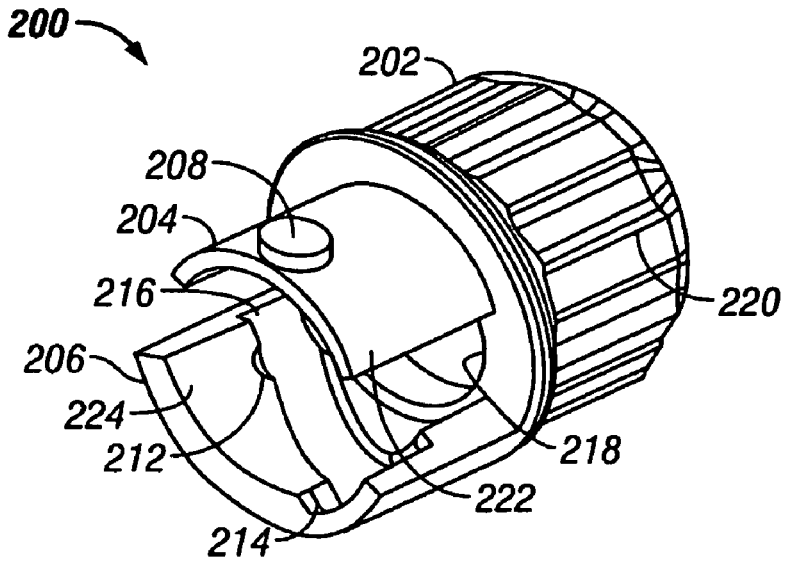
FIG. 2 is a perspective view of a connector lock ring according to the present invention.
Figure 3:
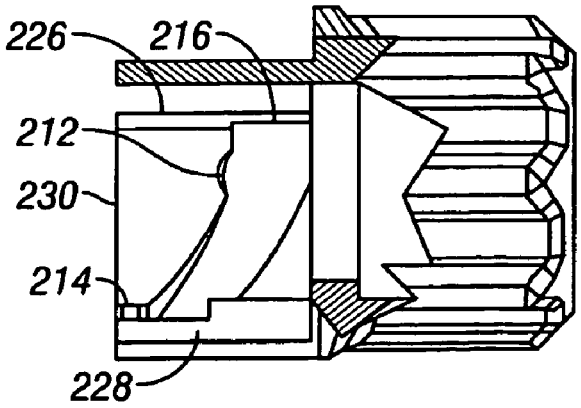
FIG. 3 is a partial cross section of the connector lock ring of FIG. 2.

FIG. 2 is a perspective view of a connector coupling ring or lock ring 200 according to the present invention, and FIG. 3 is a partial cross section of the connector lock ring of FIG. 2. The terms coupling ring and lock ring are used interchangeably herein. The lock ring 200 includes a ring body 202 having a substantially annular cross section to provide an axial through bore 218.

In one embodiment, the ring body 202 includes longitudinal ribs 220 for better gripping.

A male longitudinal projection 204 extends from the ring body 202. The male longitudinal projection has an outer curved surface 222. A raised stud 208 extends from the outer curved surface 222 and outwardly with respect to a center axis of the lock ring 200.

A female longitudinal projection 206 extends from the ring body 202 substantially opposite the male longitudinal projection 204. The female longitudinal projection has an inner curved surface 224 and has a groove 210 formed therein. The groove 210 traverses the surface 224 along an angled or helical path from a side edge 226 of the projection 206 near the grip portion of the ring body 202 toward a second side edge 228 and an end edge 230 of the female projection 206. The groove path departs from the helical path to form a groove exit or opening 214 in the end edge 230. In one embodiment, the groove 210 forms an exit or opening 216 in the side edge 226.

As used herein, a stud is defined as a slender elongated portion having a longitudinal dimension approximately equal to or less than the depth of the groove 210 and a first dimension extending in a radial direction from a center longitudinal axis of the stud and a second dimension extending in a radial direction from the center longitudinal axis of the stud, wherein the first dimension is less than the width of the groove 210, the second dimension and first dimension providing a cross sectional shape of the stud that may be circular, oval, square, rectangular or any other cross sectional shape providing minimal surface contact with the walls of the groove.

The term groove as used herein is defined as an elongated opening formed in a structure, the groove having a surface in the interior of said structure, wherein a cross sectional shape of the groove surface may be curved or multi-sided.

Figure 4:
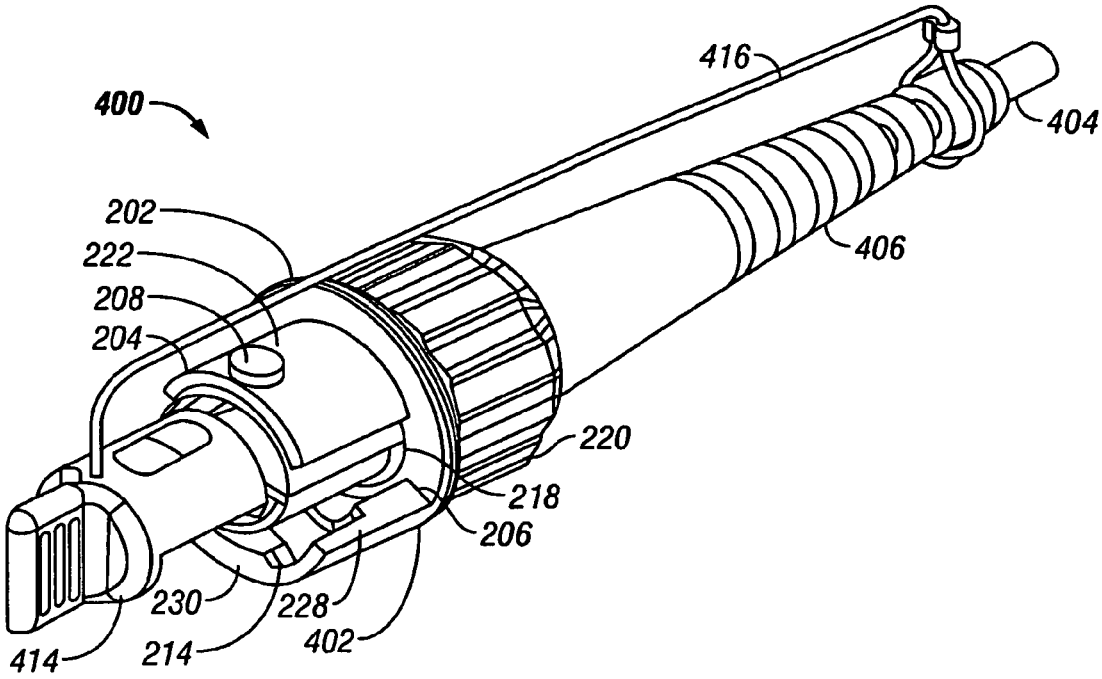
FIG. 4 is a perspective view of a cable connector according to the present invention.
Figure 5:
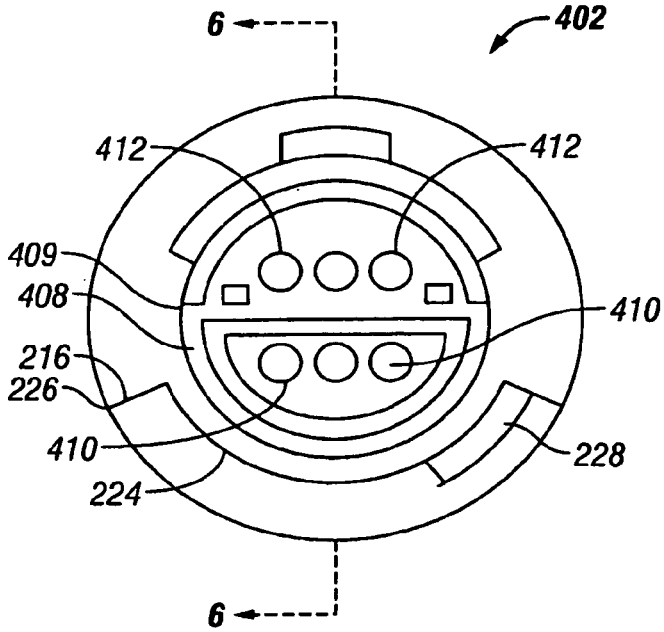
FIG. 5 is a front view of the cable connector of FIG. 4.
Figure 6:
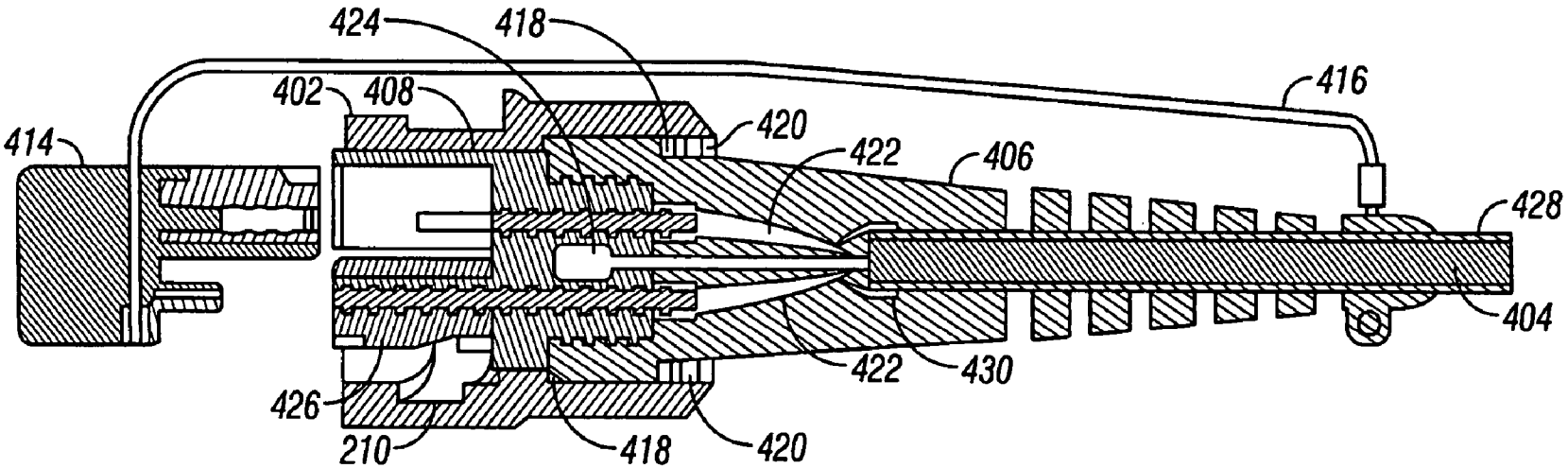
FIG. 6 is a cross section view of the cable connector of FIG. 4.

One embodiment of the present invention is a cable coupling, which will now be described in reference to FIG. 2, FIG. 4, FIG. 5 and FIG. 6. FIG. 4 is a perspective view of a cable connector 400 according to the present invention, and FIG. 5 is a front view of the cable connector 400 of FIG. 4. FIG. 6 is a cross section view of the cable connector 400 of FIG. 4.

The cable connector 400 includes a connector lock ring 402. The lock ring 402 is coupled to and rotatable about the body 409 of an electrical connector 408. The lock ring is otherwise substantially as described above and shown in FIGS. 2 and 3. The lock ring 402 includes a ring body 202 having a substantially annular cross section to provide an axial through bore 218 for receiving the electrical connector 408. The ring body 202 may include longitudinal ribs 220 for better gripping.

A male longitudinal projection 204 extends from the ring body 202. The male longitudinal projection has an outer curved surface 222. A stud projection 208 extends from the outer curved surface 222 and outwardly with respect to a center axis of the lock ring 200.

A female longitudinal projection 206 extends from the ring body 202 substantially opposite the male longitudinal projection 204. The female longitudinal projection has an inner curved surface 224 and has a groove 210 formed therein. The groove 210 traverses the surface 224 along an angled or helical path from a side edge 226 of the projection 206 near the grip portion of the ring body 202 toward a second side edge 228 and an end edge 230 of the female projection 206. The groove path departs from the helical path to form a groove exit or opening 214 in the end edge 230. In one embodiment, the groove 210 forms an exit or opening 216 in the side edge 226.

The cable connector 400 includes an electrical cable 404 comprising insulated electrical conductor wires 422 surrounded by a protective jacket 428. The wires 422 terminate in the electrical connector 408.

In one embodiment, the electrical connector 408 is a hermaphrodite electrical connector that includes electrical contact pins 410 and electrical contact sockets 412. And an optional dust cap 414 is used to protect the electrical connector 408 when the connector 408 is not connected to a mating connector. The dust cap 414 may be secured to the cable connector 400 using a tether 416. A seal insert 426 is used to keep moisture and debris from entering the interior of the connector assembly when the dust cap is removed.

A boot 406 provides strain relief for the cable 404. The boot 406 is also a housing for the cable 404 and the electrical connector 408. The boot is secured to the electrical connector 408 and is movably coupled to the lock ring 402. Anti-friction washers 418 may be used for easier rotation of the lock ring 402 about the electrical connector and boot.

A retaining ring 420 fits within an annular groove 432 in the lock ring 402 to hold the lock ring 402 on the boot while still allowing rotation. The retaining ring 420 is removable to allow front-end disassembly of the cable connector 400. This is advantageous when a field repair is necessary. There is no need to cut the cable 404 to repair a connector according to this embodiment. Once the retaining ring 420 is removed, the lock ring 402 can be removed from the assembly for replacement of the lock ring or to provide access to the electrical connector 408.

The cable 404 terminates within the boot 406. An over wrap of insulating tape 430 can be used at the point where the jacket 428 is removed to allow connection of the wires 244 to the electrical contacts 410, 412 in the electrical connector 408. An anchor 424 is potted into the electrical connector 408 using any suitable epoxy compound. The anchor is a structural member providing strain relief for the interface between the wires 422 and the electrical contacts 410, 412.

Figure 7:
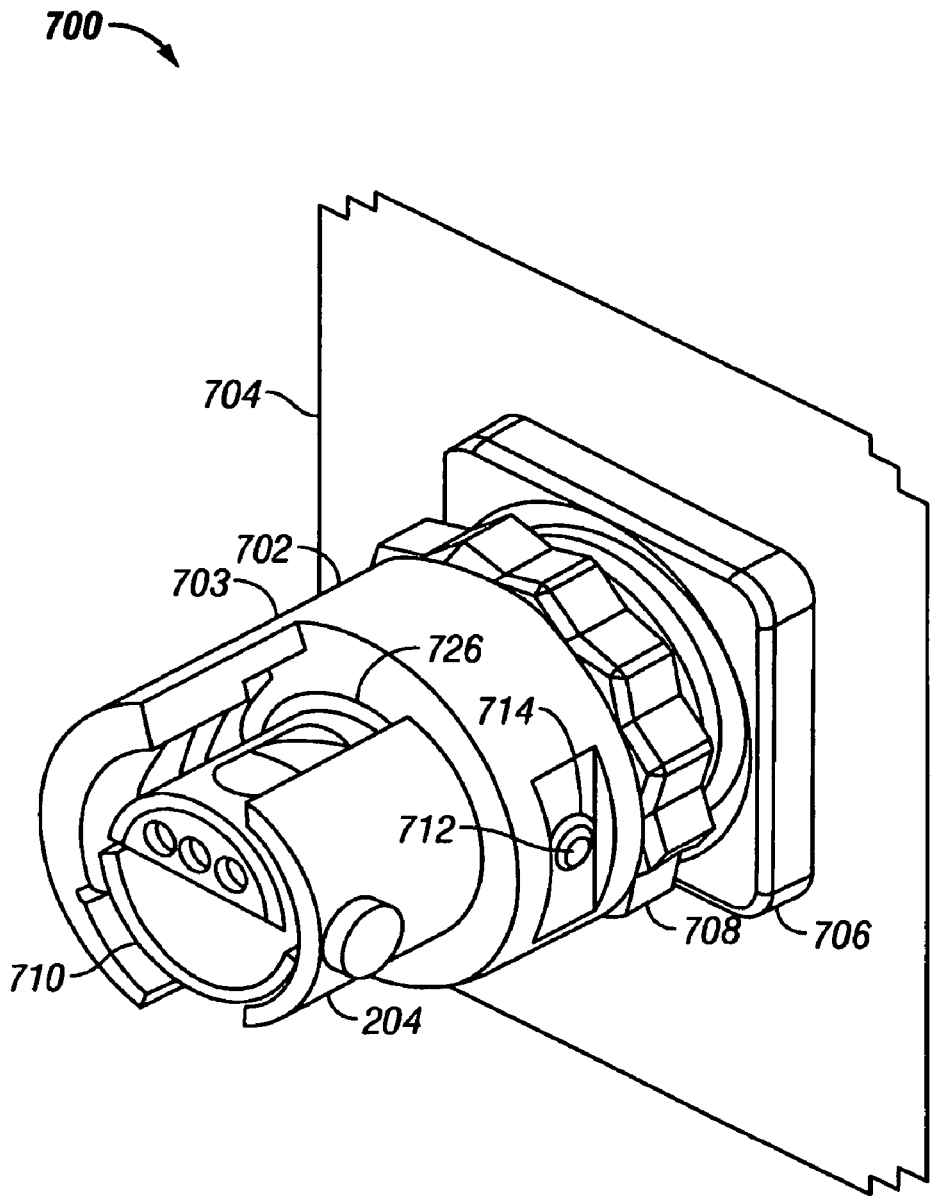
FIG. 7 is a perspective view of a panel-mount connector according to the present invention.

Another embodiment of the present invention is a panel-mount connector, which will be described in reference to FIG. 2, FIG. 3 and FIGS. 7–10. FIG. 7 is a perspective view of a panel-mount connector 700 according to the present invention.

Figure 8:
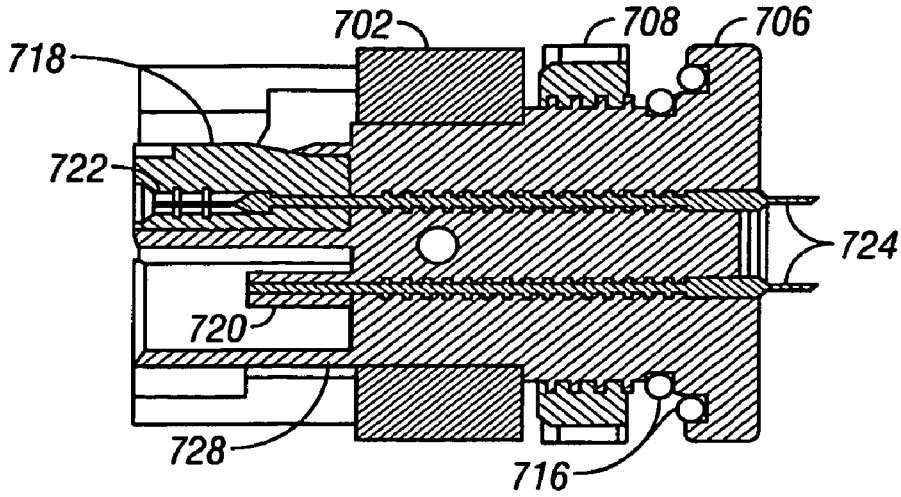
FIG. 8 is a cross section view of the panel-mount connector of FIG. 7.
Figure 9:
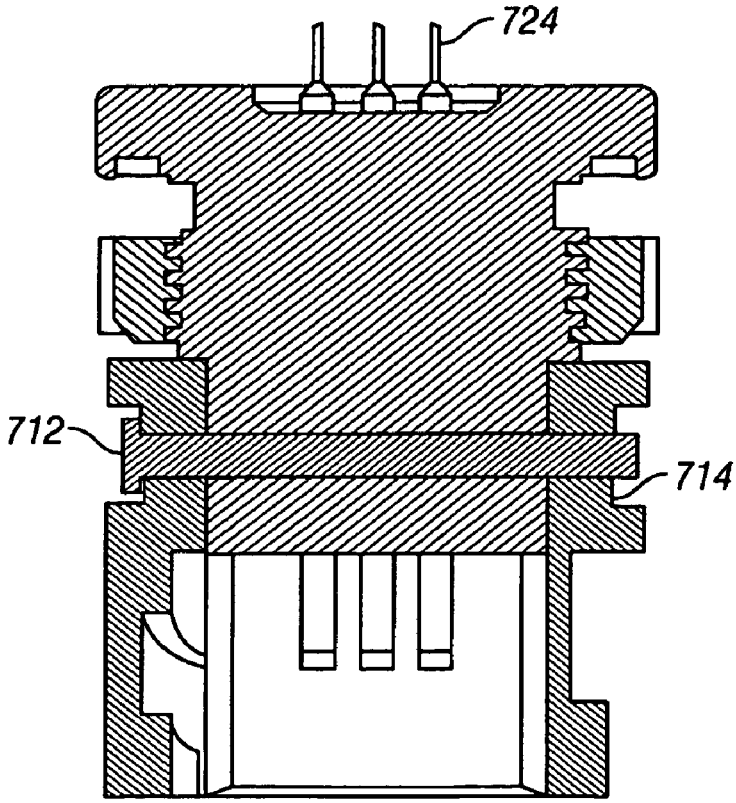
FIG. 9 is a cross section view of the panel-mount connector of FIG. 7.
Figure 10:
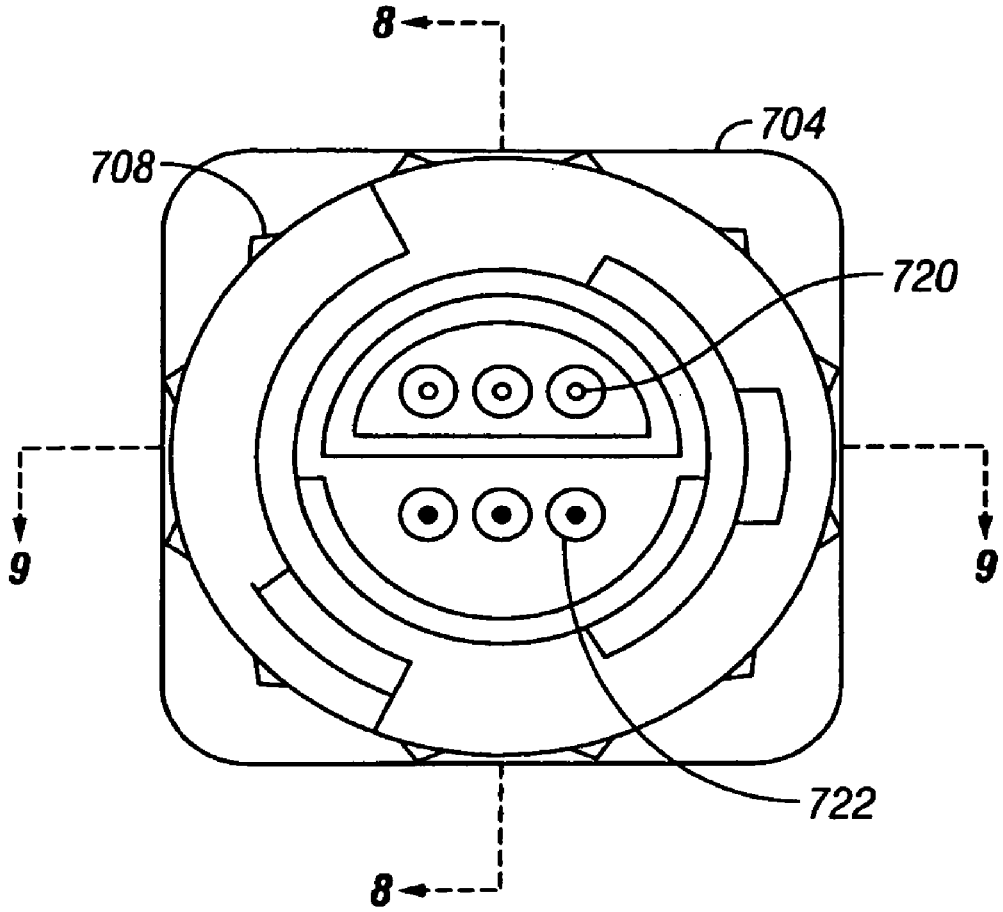
FIG. 10 is a front view of the panel-mount connector of FIG. 7.

FIG. 8 and FIG. 9 are cross section views of the panel-mount connector of FIG. 7, and FIG. 10 is a front view of the panel-mount connector of FIG. 7.

Figure 1:
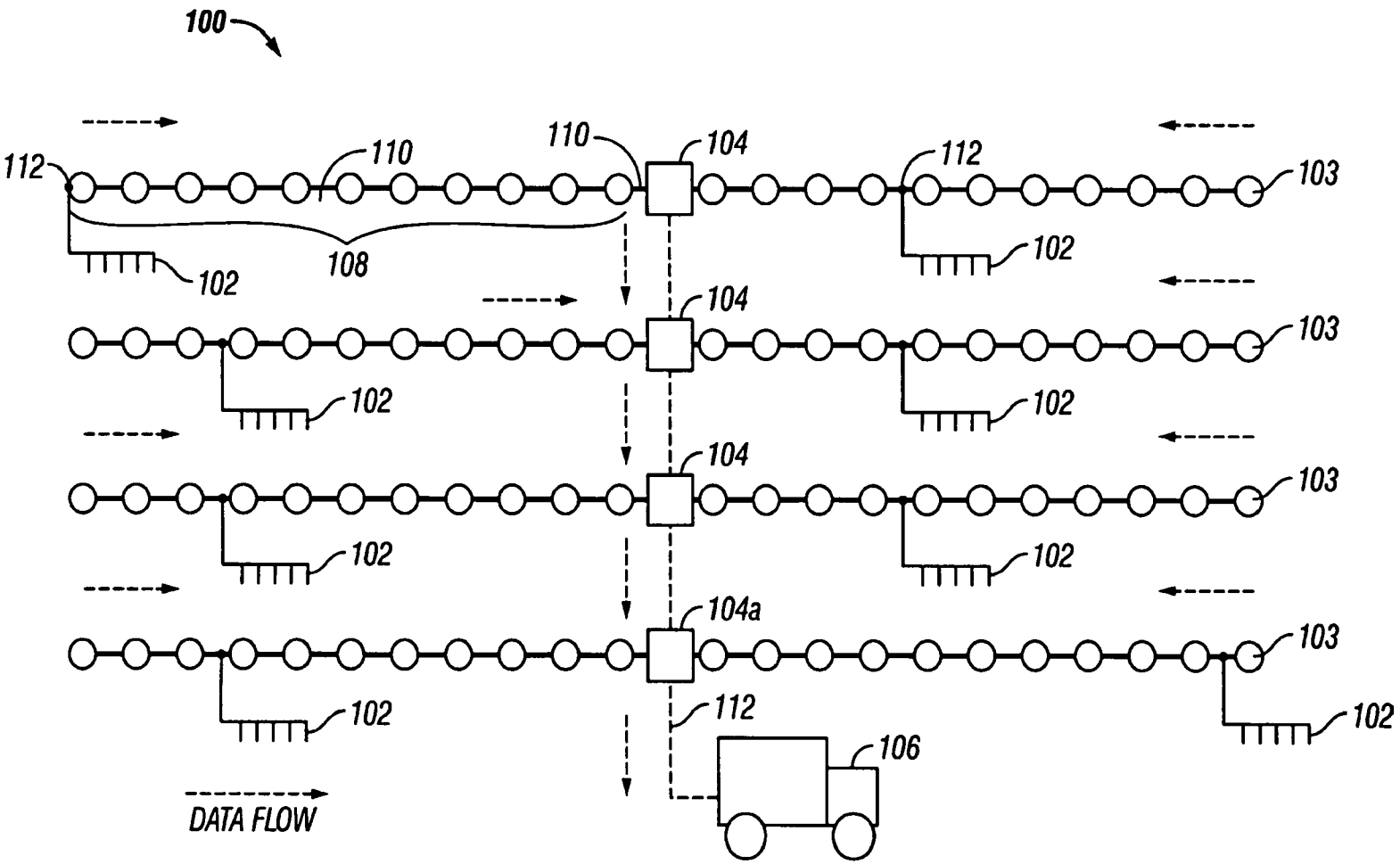
FIG. 1 (Prior Art)
FIG. 1 (Prior Art) shows a typical cable system.

The embodiment shown is used for mounting the panel-mount connector 700 to a housing 704. The housing 704 might be any housing requiring a break-out for internal components. When using the present invention in a seismic survey system, such as the system 100 of FIG. 1, the housing 704 may be a field box 103, a crossline unit 104, the central controller 106 or any other seismic system box or panel where it is desirable to connect a cable.

The panel-mount connector 700 includes a lock ring 702 that is similar to the lock ring 200 described above and shown in FIGS. 2 and 3. The lock ring 702 includes a ring body 703 having a substantially annular cross section to provide an axial through bore 726 for receiving an electrical connector 710. A male longitudinal projection 204 extends from the ring body 703. The male longitudinal projection 204 is substantially identical to the male longitudinal projection described above and shown in FIGS. 2–3, so further description here is not necessary. A female longitudinal projection 206 extends from the ring body 703 substantially opposite the male longitudinal projection 204. The female longitudinal projection is substantially identical to the female longitudinal projection described above and shown in FIGS. 2–3, so further description here is not necessary.

The panel-mount connector 700 is secured to the device 704 using a threaded nut 708 securing the electrical connector 710 to the device 704. O-rings 716 provide a seal between the device 704 wall and the electrical connector 710 to prevent moisture and debris from entering the device 704.

In one embodiment, the lock ring 702 is not rotatable about the electrical connector 710 and is secured to the electrical connector 710 by a pin 712 extending through the lock ring and electrical connector. The pin 712 is held in place using a retaining clip 714.

In one embodiment the electrical connector is a hermaphrodite connector having both electrical pin contacts 722 and electrical socket contacts 720. The contacts 720, 722 are secured to and extend through the electrical connector body 728 and have terminals 724 for connecting to components or conductors within the device 704. A seal insert protects the pin contacts 722 and prevents moisture and debris from entering the electrical connector interior.

The lock ring 200 as described above and shown in FIGS. 2 and 3 can be used for any useful coupling where connecting and disconnecting components is desired. The lock ring 200 is especially useful in harsh environments, because the low friction between the stud 208 of one lock ring and the groove 214 of a mating lock ring. The low friction is provided by minimizing the surface area contact between the stud and groove. Such a lock ring is useful in mating electrical cables, tubes, hoses, PVC pipes and the like.

A method of making up a seismic survey system according to the present invention includes providing a coupling between two devices in the seismic survey system. The coupling is readily connectable and disconnectable by a human operator. The coupling comprises two hermaphrodite lock rings substantially as described above and shown in FIGS. 2–3. One of the two devices may be, for example, a seismic cable having a connector substantially as described above and shown in FIGS. 4–6. The second device may be, for example, another seismic cable having a connector substantially as described above and shown in FIGS. 4–6, or the second device may be a seismic survey system controller, crossline unit or field box as described above and shown in FIG. 1 and having a panel-mount connector as described above and shown in FIGS. 7–10.

The operator aligns the lock ring of the first device to the lock ring of the second device. Initial engagement of the lock rings includes inserting corresponding studs into corresponding grooves without applying axial force. Connecting the first device to the second device comprises rotating the first lock ring 90° relative to the second lock ring.

Depending on the angle of the lock ring groove, the rotation to connect the first device to the second device may be clockwise or counterclockwise.

Longitudinal force to bring the two devices together is provided by the interaction of the stud traveling in the angled groove. At the end of rotation each stud is seated in a corresponding detent formed in the corresponding groove to lock the two lock rings in place and prevent inadvertent unlocking.

Disconnecting the devices comprises rotating the first lock ring 90° relative to the second lock ring and in an opposite direction of the connecting rotation. Longitudinal force to separate the two devices is provided by the interaction of the stud traveling in the angled groove.

In one method according to the present invention self cleaning of the groove is provided. Debris such as mud or ice is pushed along the groove as the stud travels along the groove when connecting rotation is applied. At the end of the connecting rotation the debris or ice is pushed by the stud out of the groove at an end exit.

The foregoing description is directed to particular embodiments of the present invention for the purpose of illustration and explanation. It will be apparent, however, to one skilled in the art that many modifications and changes to the embodiments set forth above are possible without departing from the scope of the invention, which is defined by the claims appended hereto.

What is claimed is:

1. A seismic cable coupling comprising:

a) a cable having a first connector body;

b) a second connector body adapted for mechanical and electrical coupling to the first connector body;

c) a first coupling ring rotatably mounted on the first connector body, the first coupling ring including a first ring body having a first longitudinal projection and a second longitudinal projection, the first longitudinal projection having an interior surface including a first angled groove, the second longitudinal projection having an exterior surface including a first raised stud; and d) a second coupling ring coupled to the second connector body, the second coupling ring including a second ring body having a third longitudinal projection and a fourth longitudinal projection, the third longitudinal projection having an interior surface including a second angled groove, the fourth longitudinal projection having an exterior surface including a second raised stud, wherein the first ring body couples to the second body when the second raised stud aligns with the first groove and the first raised stud aligns with the second groove, and wherein relative rotation of the first ring body to the second ring body provides an axial coupling force.

2. The seismic cable coupling of claim 1 wherein the relative rotation is a clockwise rotation for providing the axial coupling force and relative counterclockwise rotation provides a decoupling force.

3. The seismic cable coupling of claim 1 wherein the relative rotation is a counterclockwise rotation for providing the axial coupling force and relative clockwise rotation provides a decoupling force.

4. The seismic cable coupling of claim 1, wherein the first coupling ring comprises a removable retaining ring, the first coupling ring being detachable by removing the retaining ring.

5. The seismic cable coupling of claim 1, wherein the second connector body comprises a panel-mount connector.

6. The seismic cable coupling of claim 5, wherein the second coupling ring includes a removable through pin attaching the second coupling ring to the second connector body, the second coupling ring being detachable from the second connector body by removing the through pin.

7. The seismic cable coupling of claim 1, wherein at least one of the first groove and the second groove includes a surface having a curved cross section.

8. The seismic cable coupling of claim 1, wherein at least one of the first groove and the second groove includes a surface having a multi-sided cross section.

9. The seismic cable coupling of claim 1, wherein at least one of the first raised stud and the second raised stud includes a cross section shape selected from one of i) circle and ii) oval.

10. The seismic cable coupling of claim 1, wherein at least one of the first raised stud and the second raised stud includes a cross section shape selected from one of i) square and ii) rectangle.

11. The seismic cable coupling of claim 1, wherein at least one of the first longitudinal projection and the third longitudinal projection includes an opening at an end of the groove.

12. A seismic cable coupling comprising:

a) a first connector body adapted for mechanical and electrical coupling to a second connector body; and b) a first coupling ring mounted on the first connector body, the first coupling including a first ring body having a first longitudinal projection and a second longitudinal projection, the first longitudinal projection having an interior surface including an angled groove, the second longitudinal projection having an exterior surface including a raised stud, wherein the first coupling ring is matable with a second coupling ring having a second ring body substantially identical to the ring body.

13. The seismic cable coupling of claim 12, wherein the first coupling ring is rotatably mounted on the first connector body.

14. The seismic cable coupling of claim 12, wherein the first coupling ring comprises a removable retaining ring, the first coupling ring being detachable by removing the retaining ring.

15. The seismic cable coupling of claim 12, wherein the first connector body comprises a panel-mount connector.

16. The seismic cable coupling of claim 12, wherein the first coupling ring includes a removable through pin attaching the second coupling ring to the second connector body, the first coupling ring being detachable from the first connector body by removing the through pin.

17. The seismic cable coupling of claim 12, wherein the first groove includes a surface having a curved cross section.

18. The seismic cable coupling of claim 12, wherein the first groove includes a surface having a multi-sided cross section.

19. The seismic cable coupling of claim 12, wherein the first raised stud includes a cross section shape selected from one of i) circle and ii) oval.

20. The seismic cable coupling of claim 12, wherein the first raised stud includes a cross section shape selected from one of i) square and ii) rectangle.

21. The seismic cable coupling of claim 12, wherein the first longitudinal projection includes an opening at an end of the groove.

22. A method of coupling a seismic cable comprising:

a) providing a cable having a first connector body;

b) providing a second connector body adapted for mechanical and electrical coupling to the first connector body;

c) providing a rotatable first coupling ring on the first connector body, the first coupling ring including a first ring body having a first longitudinal projection and a second longitudinal projection, the first longitudinal projection having an interior surface including a first angled groove, the second longitudinal projection having an exterior surface including a first raised stud;

d) providing a second coupling ring on the second connector body, the second coupling ring including a second ring body having a third longitudinal projection and a fourth longitudinal projection, the third longitudinal projection having an interior surface including a second angled groove, the fourth longitudinal projection having an exterior surface including a second raised stud;

e) aligning the second raised stud with the first groove and aligning the first raised stud with the second groove; and f) rotating the first ring body relative to the second ring body to provide an axial coupling force coupling the seismic cable.

23. The method of claim 22 further comprising rotating the first coupling ring clockwise to provide the axial coupling force and rotating the first coupling ring counterclockwise to provide a decoupling force.

24. The method of claim 22 further comprising rotating the first coupling ring counterclockwise to provide the axial coupling force and rotating the first coupling ring clockwise to provide a decoupling force.

* * * * *